US008764406B2

(12) United States Patent
Filippi

(10) Patent No.: US 8,764,406 B2
(45) Date of Patent: Jul. 1, 2014

(54) FLUID LEVEL CONTROL MECHANISM

(76) Inventor: William K. Filippi, Huntington Beach, CA (US)

( * ) Notice: Subject to any disclaimer, the term of this patent is extended or adjusted under 35 U.S.C. 154(b) by 439 days.

(21) Appl. No.: 13/249,856

(22) Filed: Sep. 30, 2011

(65) Prior Publication Data

US 2012/0082571 A1 Apr. 5, 2012

Related U.S. Application Data

(60) Provisional application No. 61/389,438, filed on Oct. 4, 2010.

(51) Int. Cl.

| | |
|---|---|
| ***F04B 49/04*** | (2006.01) |
| ***E21B 43/00*** | (2006.01) |
| ***F04D 15/02*** | (2006.01) |
| ***F04B 49/025*** | (2006.01) |
| ***E21B 43/12*** | (2006.01) |

(52) U.S. Cl.

CPC ..... *F04D 15/0218* (2013.01); *F04B 49/025* (2013.01); *E21B 43/128* (2013.01)

USPC ..... 417/40; 417/278; 166/105

(58) Field of Classification Search

CPC .. F04D 13/086; F04D 15/0218; F04B 49/025

USPC ..... 417/40, 278, 279; 166/54, 105; 137/563

See application file for complete search history.

(56) References Cited

U.S. PATENT DOCUMENTS

| | | | | |
|---|---|---|---|---|
| 2,179,207 | A * | 11/1939 | Whitehurst | 137/400 |
| 3,299,815 | A * | 1/1967 | Thaw | 417/2 |
| 3,459,403 | A | 8/1969 | Royer | |
| 3,490,280 | A * | 1/1970 | Fields | 73/152.14 |
| 3,861,471 | A | 1/1975 | Douglas | |
| 4,028,011 | A * | 6/1977 | Kramer | 417/278 |
| 5,382,142 | A * | 1/1995 | Spears | 417/445 |
| 6,497,556 | B2 * | 12/2002 | Zupanick et al. | 417/85 |
| 6,550,535 | B1 * | 4/2003 | Traylor | 166/265 |
| 7,438,125 | B2 | 10/2008 | Victor | |
| 2007/0277984 | A1 * | 12/2007 | Farrara | 166/369 |
| 2009/0102200 | A1 * | 4/2009 | Greenspan et al. | 290/53 |
| 2011/0259591 | A1 * | 10/2011 | Vinegar | 166/302 |

FOREIGN PATENT DOCUMENTS

WO WO01/53653 * 7/2001

* cited by examiner

*Primary Examiner* — Charles Freay
(74) *Attorney, Agent, or Firm* — Stetina Brunda Garred & Brucker

(57) ABSTRACT

A fluid level control mechanism comprising a float assembly, a flow line assembly, an upper centralizer, and a lower centralizer. The float assembly has a cylindrical outer float tube and a cylindrical inner float tube connected by upper and lower end plates to form a sealed cavity. The flow line assembly has a main flow line capable of passing a fluid, a diverter flow line, and a diverter valve. The diverter valve is connected to the lower end plate of the float assembly via a lever arm, such that the float assembly is capable of sliding along the length of the main flow line in response to a fluid level. Downward movement of the float assembly opens the diverter valve and upward movement of the float assembly closes the diverter valve. The upper and lower centralizers center the mechanism within a well bore.

14 Claims, 4 Drawing Sheets

FLUID LEVEL CONTROL MECHANISM

CROSS-REFERENCE TO RELATED APPLICATIONS

This application claims the benefit of U.S. Provisional Application No. 61/389,438, filed on Oct. 4, 2010, the teachings of which are expressly incorporated by reference.

STATEMENT RE: FEDERALLY SPONSORED RESEARCH/DEVELOPMENT

Not Applicable

BACKGROUND

1. Field of the Invention

The present apparatus relates to a fluid level control mechanism for maintaining a fluid level at a predetermined point within a well. More specifically, the fluid level control mechanism comprises a float assembly a flow line assembly, and upper and lower centralizers for controlling the fluid level in a well by diverting some production fluid, as necessary, back into the well to maintain the fluid level at the predetermined point.

2. Description of the Related Art

When a well is not being produced, the fluid level in the well will rise due to the pressure in the well's production formation. The fluid level will continue to rise until the column of fluid in the well bore exerts a pressure on the formation equal to the formation pressure. At this point, fluid from the formation will stop flowing into the well and the fluid level will stop rising. This level is called the static fluid level. Once the well is put into production the fluid level in the well bore will begin to drop. As the fluid level drops, pressure on the formation is relieved and fluid from the formation will begin to flow into the well. If the fluid level continues to drop, more fluid will flow from the production zone at an increasing rate. If less fluid is pumped out of the well than the formation can produce, the fluid level will eventually stabilize at some point above the pump. At this point, fluid being pumped out of the well equals fluid flowing into the well. If more fluid than the production formation can produce is pumped out of the well, the fluid level will drop to the level of the pump's inlets and the pump will cavitate, eventually damaging production equipment. In this case, the pump is attempting to pump more fluid than the formation can produce. Maximum well production is achieved when all the fluid a well can produce is pumped to the surface. As such, in order to maximize well production (whether for oil, water, or gas) while simultaneously protecting production equipment, there is a need for mechanisms that will maintain the fluid level within a well to a position immediately above the pump's location in the well.

Maximum fluid production from a well is achieved when the fluid level is pulled down to the production formation and all pressure is removed from the formation. In an oil well, relieving this pressure not only maximizes the amount of fluid being produced but also increases the oil to water ratio since water flows more easily through a formation than oil. The most common way of producing an oil well is with a production string which consists of a pumping unit, tubing, rods, and a mechanical downhole pump. The pumping unit, located at the surface, is powered by an electric motor, pulleys, and drive belts. It produces an up and down motion which actuates the downhole pump through a series of rods which connect the pumping unit to the downhole pump. The rods run through the center of a string of tubing which also runs from the downhole pump to the surface of the well. The tubing provides a conduit for the production fluid to flow to the surface of the well. As the pumping unit strokes up and down, a plunger within the pump also strokes up and down. All the fluid, less leakage, that enters the pump is lifted to the surface. Each stroke of the pump sucks fluid into the pump and then lifts it to the surface. The amount of fluid being pumped is governed by pump size, stroke length of the pumping unit, and the number of strokes per minute. The fluid production can be slightly adjusted by changing the strokes per minute. All other variables would require considerable expense to change. The strokes per minute are adjusted by changing pulley and drive belts. This method of controlling production does not lend itself to fine adjustment of fluid flow.

A second and less common method of producing an oil well is with an electrically driven downhole pump. This is also the method used for producing the vast majority of water and gas wells. The downhole pump is connected to the bottom of a tubing string that reaches from the downhole pump to the surface of the well. An electric motor is connected to the bottom end of the pump. An electrical power cable extends from the surface to the pump motor and provides the power to run the motor. The motor drives the pump, which pumps fluid through the tubing to the surface of the well. This method of pumping gives a relatively constant flow rate which can be somewhat adjusted with the use of flow control valves. Flow control valves cannot be used with pumping units since they produce a given amount of fluid with each stroke regardless of valve opening.

Both methods of pumping run into problems if the fluid level in the well is pulled down to the level of the pump's inlets. This will happen if the pump produces more fluid than the well's formation can give up. In the case of mechanically driven pumps, the pump's intake chamber will not completely fill with fluid during each pumping unit stroke, resulting in air entering the chamber. This causes a pounding or jarring effect with each production stroke. The pump will continue to produce under this condition but, in time, the constant pounding will damage the pump, the production string, and the pumping unit. In the case of an electrically driven pump, the consequences are even more severe. Should the pump run dry, both the motor and the pump can be severely damaged in a very short time. If the pump runs dry, it will begin to heat up thereby damaging rings, seals, and the impellers within the pump, causing the pump to quickly fail. Furthermore, the motor on an electrically driven pump is located below the pump and needs a constant flow of fluid to cool the motor. If the pump fails, the cooling flows of fluid past the motor will stop and the motor will overheat and burn out within minutes.

As such, one would desire to pick a pump which produces the same amount of fluid as the well gives up. In the case of mechanically driven pumps, this simply cannot be done for several reasons. First, pumps do not come in an infinite range of production rates. Second, the use of pulleys, belts, and stroke length to adjust flow rates does not lend itself to the fine adjustments necessary to match the formation rate. In the case of electrically driven pumps, the production rates can be more easily controlled through the use of control valves. However, electrically driven pump rates are affected by a number of factors that do not affect mechanical pumps. These factors also interact with each other and include, but are not limited to, frictional losses in the piping system, changes in downstream pressure in the production lines, pump and motor wear and loss of efficiency, changes in supplied voltage and amps, changes in the production fluid's viscosity, and changes in the amount of fluid a well can give up at any given time. Frictional losses, for example, are a function of rate of fluid flow. As the flow rate changes, the frictional losses change. This means that as one variable changes, it affects a second variable. Changes in downstream pressure can occur if there is a change in the production rate of a downstream well. The specific gravity and viscosity of the production fluid will change as the oil to water ratio changes during normal production. All of these factors interact and make fine adjusting of flow rates next to impossible.

Furthermore, and possibly most importantly, well formations do not produce fluid at either a constant flow rate or a constant viscosity. Formation flow rates can change from day to day or even hour to hour. In oil wells, the viscosity of the production fluid is also constantly changing as more or less oil is produced. This makes it impossible to size a pump to exactly match a well's formation flow. In order to overcome this problem and avoid damaging pumps and equipment, one has had to previously maintain the fluid level in wells well above the pump inlets or utilize timers or other devices to turn pumps on and off during production. These methods, however, result in inefficient production, with a decrease in both total fluid production and oil to water ratio and the starting and stopping of motors and pumps severely shortens their life span, since the life cycle of both electric motors and pumps is best when turned on and left to run constantly.

Accordingly, there is a need for a way of placing the downhole pump within or as close as possible to the production formation while automatically adjusting the amount of fluid being produced from the well so as to pull the fluid level down to just above the pump's inlets and maintain it at this level.

BRIEF SUMMARY

One embodiment of the present disclosure is directed toward a fluid level control mechanism having a float assembly, a flow line assembly, and upper and lower centralizers. The float assembly has a cylindrical outer float tube and a cylindrical inner float tube, wherein an upper portion of the outer float tube is connected to an upper portion of the inner float tube by an upper end plate disposed between the outer and inner float tubes and a lower portion of the outer float tube is connected to a lower portion of the inner float tube by a lower end plate disposed between the outer and inner float tubes. As such, a sealed cavity is formed between the outer float tube and the inner float tube. The float assembly may be pressurized and may have a pressure valve disposed between the inner float tube and the outer float tube to control the pressurization. The flow line assembly is positioned below the float assembly and includes a main flow line capable of passing a fluid therethrough, a diverter flow line in fluid communication with the main flow line, and a diverter valve disposed within the diverter flow line. The diverter valve is connected to the lower end plate of the float assembly via a lever arm. The float assembly is disposed along a length of the main flow line and capable of sliding movement along the length of the main flow line, such that a downward movement of the float assembly opens the diverter valve and an upward movement of the float assembly closes the diverter valve. The lower centralizer is positioned along the main flow line below the flow line assembly and the upper centralizer is positioned along the main flow line above the float assembly, wherein the upper and lower centralizers each have a diameter larger than the float assembly.

The fluid level control mechanism may further include at least one rib plate, wherein a middle portion of the outer float tube is connected to a middle portion of the inner float tube by the rib plate. The rib plate will usually have at least one hole for allowing the passage of air during pressurization. The fluid level control mechanism also may have a lower bumper attached to a lower portion of the float assembly, wherein the lower bumper tapers to a diameter narrower than the diameter of the float assembly and/or an upper bumper attached to an upper portion of the float assembly, wherein the upper bumper tapers to a diameter narrower than the diameter of the float assembly. The upper bumper may have a liquid reservoir portion capable of containing a liquid.

The upper centralizer may take the shape of a disc having a diameter greater than the diameter of the float assembly and may be formed from neoprene or some other similar material. The upper centralizer disc may have at least one hole capable of passing a fluid therethrough.

The fluid level control mechanism may further include an upper float stop positioned on the main flow line above the float assembly, such that when the diverter valve is fully closed an upper portion of the float assembly is in contact with the upper float stop, and/or a lower float stop positioned on the main flow line below the float assembly, such that when the diverter valve is fully opened a lower portion of the float assembly is in contact with lower float stop. The fluid level control mechanism may also include at least one alignment blade protruding outward from the main flow line and may include at least one anti-rotation guide disposed within the inner float tube, such that the alignment blade fits within the anti-rotation guide to prevent rotation of the float assembly in relation to the main flow line. However, the alignment blade may serve other purposes and, as such, may be present without a corresponding anti-rotation guide.

In one embodiment of the present disclosure, the outer float tube, inner float tube, upper end plate, and lower end plate are formed from aluminum and the main flow line is formed from stainless steel tubing.

Additionally, the fluid level control mechanism may further include a valve extension arm positioned between the diverter valve and the lever arm, the diverter valve may include a self-cleaning filter, and/or at least one pressure regulator disposed within the diverter flow line.

The present disclosure also envisions a pumping apparatus made up of a production string and a fluid level control mechanism as described above. The production string includes a pumping unit, a mechanical downhole pump, at least one rod connecting the mechanical downhole pump to the pumping unit, and tubing capable of transporting a fluid from the downhole mechanical pump to the pumping unit. The fluid level control mechanism is disposed in line with the tubing between the mechanical downhole pump and the pumping unit, wherein the fluid level control mechanism comprises a float assembly and a flow line assembly. The pump rods would pass through the fluid level control mechanism.

The present disclosure further envisions a pumping apparatus made up of an electrically driven downhole pump and a fluid level control mechanism as described above. The fluid level control mechanism is disposed above the downhole pump.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
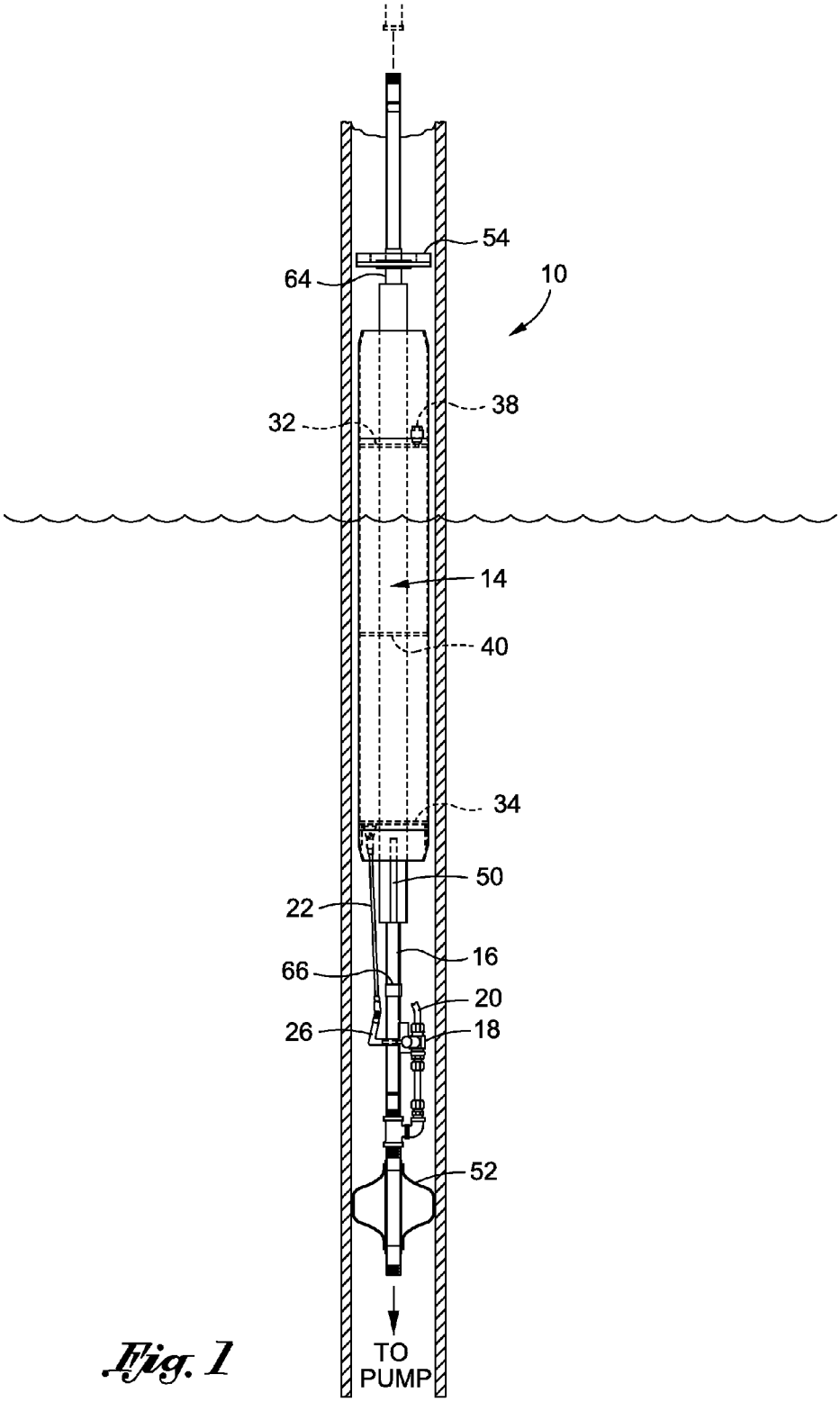
FIG. 1 is a side plan view of a fluid level control mechanism of the disclosed device.
Figure 2:
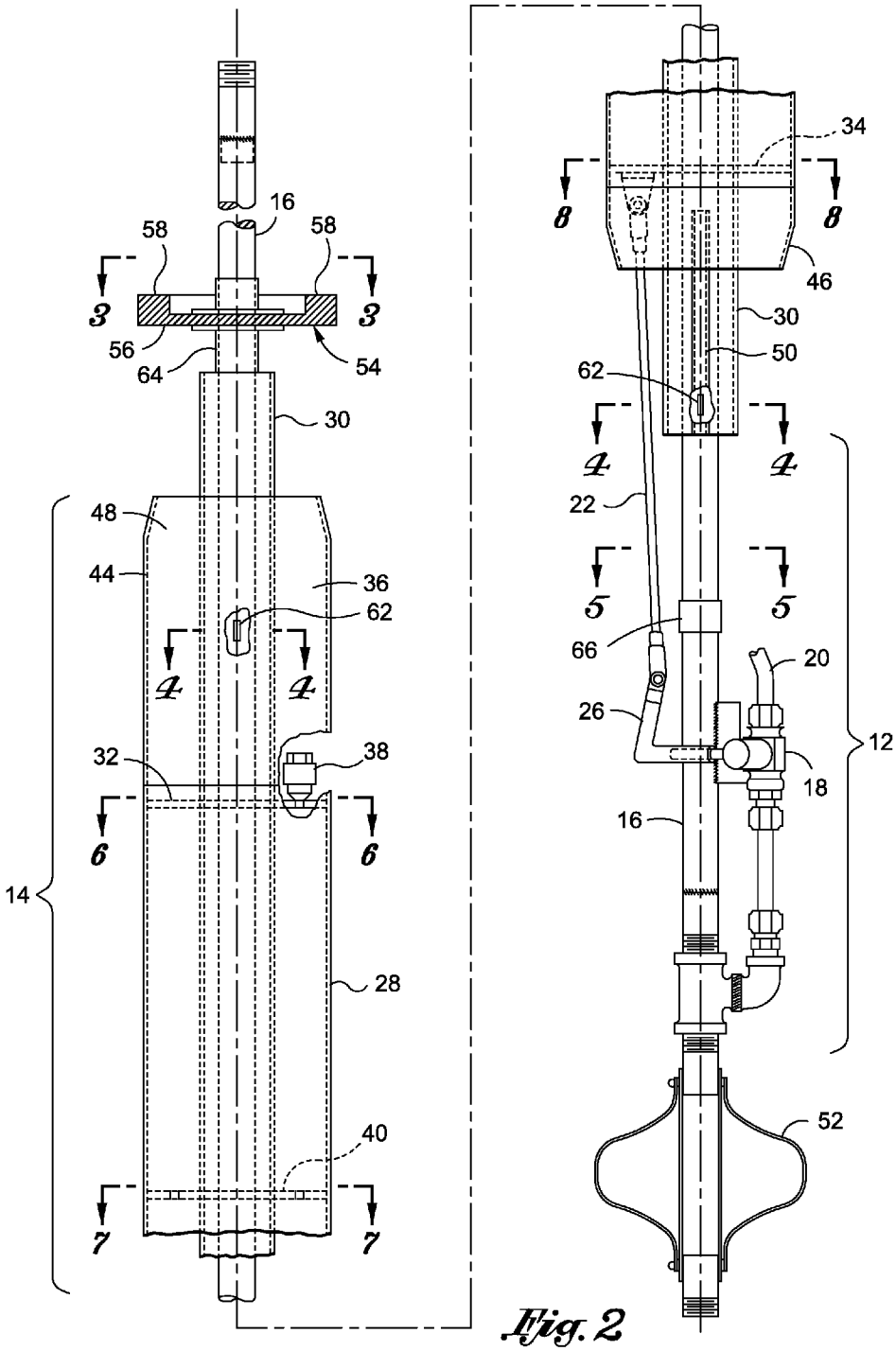
FIG. 2 is a side cross-sectional view of the device shown in FIG. 1.
Figure 3:
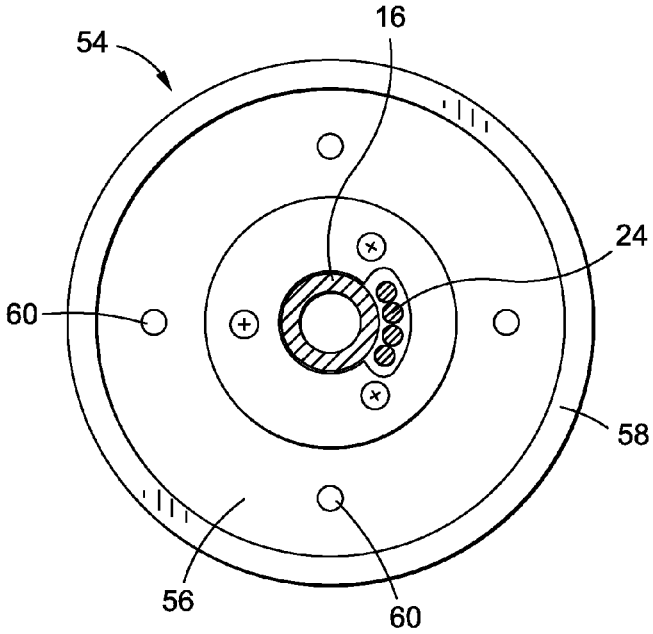
FIG. 3 is a top cross-sectional view of an upper centralizer of the device shown in FIG. 1.
Figure 4:
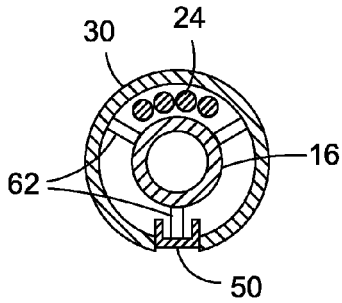
FIG. 4 is a top cross-sectional view of a float assembly of the device shown in FIG. 1.
Figure 5:
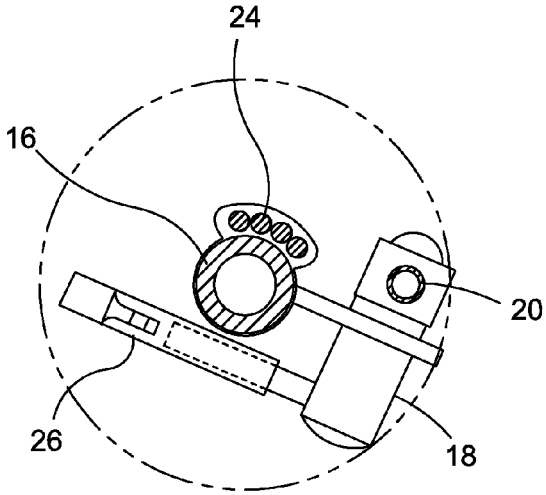
FIG. 5 is a top cross-sectional view of a flow line assembly of the device shown in FIG. 1.
Figure 6:
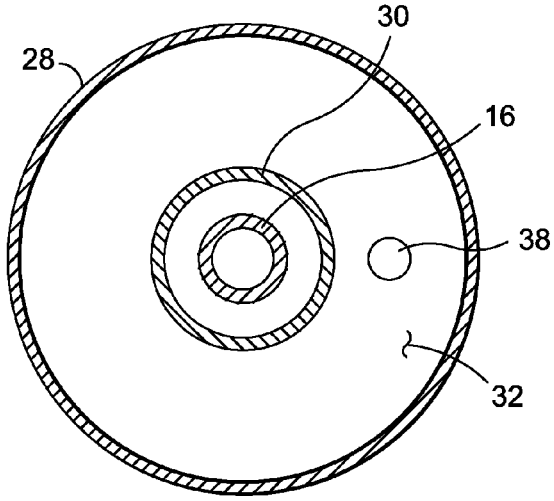
FIG. 6 is a top cross-sectional view of an upper end plate of the device shown in FIG. 1.
Figure 7:
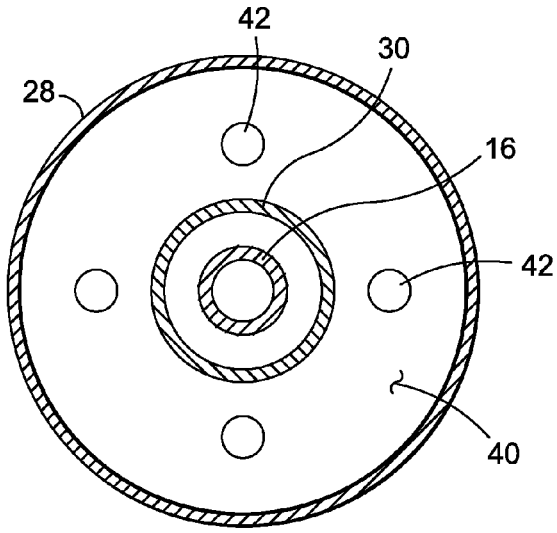
FIG. 7 is a top cross-sectional view of an internal rib of the device shown in FIG. 1.
Figure 8:
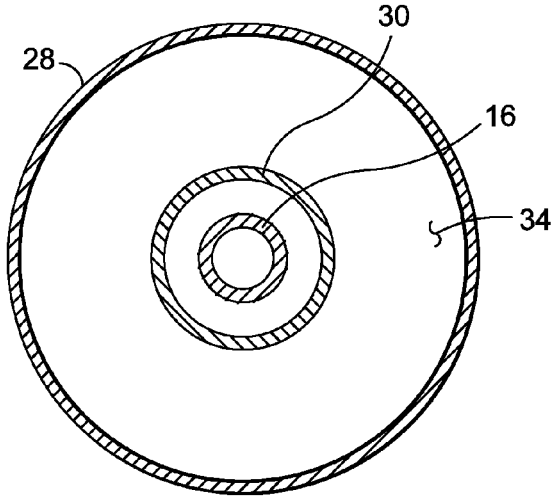
FIG. 8 is a top cross-sectional view of a lower end plate of the device shown in FIG. 1.

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

In one embodiment of the present disclosure, a fluid level control mechanism 10 is placed in a well above a downhole pump and inline with a production string (i.e., the tubing that transports fluid from the downhole pump to the surface of the well). The fluid level control mechanism 10, which can be set at any location above the pump as desired, ensures that the fluid level in the well will not fall below the fluid level control mechanism's location. In this embodiment, the fluid level control mechanism 10 includes a flow line assembly 12 and a float assembly 14. The flow line assembly 12 includes a main flow line 16 which taps into the production string and a diverter valve 18 which diverts production fluid back into the well via a diverter flow line 20. The float assembly 14 is attached to the diverter valve 18 via a lever arm 22, thereby opening and closing the diverter valve 18 as the float assembly 14 moves. As the fluid in the well rises and falls, the diverter valve 18 is opened and closed thereby diverting variable amounts of production fluid back into the well bore.

The amount of fluid being diverted at any given time is the difference between the amount of fluid being pumped out of the well and the amount of formation fluid flowing into the well. When the formation flow into the well is greater than that being pumped out of the well, the fluid level in the well will rise and the diverter valve 18 will remain closed. When fluid flow into the well is less than being pumped out of the well, the fluid level within the well will fall. When the fluid level falls to the level of the mechanism's float assembly 14, the diverter valve 18 will begin to open thereby diverting some fluid back into the well. The amount of fluid being diverted may be constantly changing to maintain a balance between formation flow into the well and production flow out of the well.

The flow line assembly 12 includes a main flow line 16 that runs through the center of the float assembly 14. The main flow line 16 may be formed from stainless steel tubing. By using tubing, rather than pipes, the internal diameter is maximized while the outer diameter is minimized. As such, the flow area through the main flow line 16 is maximized, flow line loss is minimized, and allows for a larger area between the flow line 16 and the inner wall 30 of the float assembly 14, which may contain electrical wires 24 for a pump motor. However, since threads cannot be machined into the thin walls of tubing, threaded pipe fittings may be manufactured and welded to each end of the tubing for connecting to the production string.

The flow line assembly 12 further includes a diverter flow line 20 in fluid communication with the main flow line 16 and containing a diverter valve 18. The diverter valve 18 is connected to the float assembly 14 via a lever arm 22, such that when the float assembly 14 rises the diverter valve 18 is closed and when the float assembly 14 falls the diverter valve 18 is opened, thereby diverting the production fluid back into the well. The diverter flow line 20 may be aimed upward to emulsify an oil pad, or it may be aimed downward to cool a pump motor. To minimize the force required to open and close the diverter valve 18, a valve extension arm 26 may be added to the diverter valve 18. By increasing the valve arm's length, the extension arm 26 decreases the force required to produce a given torque and its shape allows for an equal distribution of weight during rotation.

The float assembly 14 may be in the shape of a cylindrical doughnut, formed by an outer float tube 28, an inner float tube 30, and sealed by an upper end plate 32 and a lower end plate 34. As such, an internal cavity 36 is formed between the outer 28 and inner 30 float tubes and the upper 32 and lower 34 end plates. The float assembly 14 may further include a pressurization valve 38 (optionally located on the upper end plate 32) to pressurize the internal cavity 36. Furthermore, the internal cavity 36 of the float assembly 14 may include one or more internal ribs 40 to provide additional structural integrity. The end plates 32, 34 and internal ribs 40 may be annular in shape. The internal ribs 40 may further contain holes to allow air to pass between compartments within the internal cavity 36.

In forming the float assembly 14 for a particular well, the outer diameter of the outer float tube 28 must be small enough to fit within the well bore, while the inside diameter of the inner float tube 30 must be large enough to fit over the production string and any electrical wires 24 that may be running to a submersible downhole pump. The total volume of the float assembly 14 provides a buoyant force when the float 14 is submerged. The greater the volume of the float assembly 14, the greater the buoyant force. Since the outer and inner diameters of the float 14 may be predetermined by the specific application, one can increase or decrease the cavity volume by increasing or decreasing the length of the float assembly 14. Additionally, however, the net buoyant force is also dependent on the weight of the float, the degree of submergence of the float, and the specific gravity of the surrounding fluid. Maximum buoyant force is achieved when the float 14 is completely submerged. The amount of buoyant force required in any specific application is determined by the torque required to close the diverter valve.

Since the actual weight of the float has to be subtracted from the calculated buoyant force to determine the net buoyant force, ideally the weight of the float assembly 14 would be kept to a minimum. One way of minimizing weight is the use of thin walled, light weight tubing and materials in the construction of the float assembly 14. For example, the inner 30 and outer 28 float tubes and the upper 32 and lower 34 end plates may be formed from thin walled aluminum. However, the use of these light-weight materials creates potential structural integrity problems. As the float 14 is lowered into the well, the static fluid exerts an external pressure on the float assembly 14. This pressure builds as the float 14 is lowered. When using thin walled cylinders, the pressure may ultimately become enough to cause the walls of the float assembly 14 to buckle and collapse.

Certain methods may be used to overcome this structural integrity problem, for example, using heavier materials or adding internal ribs 40 to support the walls. However, both of these methods will add weight to the float assembly 14, thereby requiring increasing the float assembly length to maintain the same buoyant force. As can be seen, adding length to the float assembly 14 will, itself, add further weight to the float assembly 14. As such, another method to compensate for the external pressure is to pressurize the float assembly itself with internal pressure. In this case, the internal pressure within the float assembly 14 will counter the external pressure caused by the static fluid level. The amount of internal pressurization is also limited by the structural strength of the float assembly 14. However, cylinders collapse at much lower external pressure than they will explode at from internal pressure. For most wells, a small internal pressure is sufficient to balance external pressures. As can be seen, material selection, rib design, and internal pressurization may all be utilized to achieve an optimal design for a particular well.

Additionally, in order to help protect the float assembly 14 as it passes through small openings or obstructions, alignment bumpers 44, 46 may be attached to upper and/or lowers portions of the float assembly 14. The diameter of the bumper 44, 46 may taper to a diameter narrower than that of the float assembly 14 to guide the float assembly through the well bore.

While the amount of buoyant force necessary is determined by the torque required to close the diverter valve 18, the amount of torque required to open the diverter valve 18 must also be exceeded by the downward force (weight) of the float assembly 14. This potentially creates a problem, in that when closing the diverter valve 18 one desires minimum weight and increased buoyant force, whereas when opening the diverter valve 18 one desires minimized buoyant force and increased weight. Accordingly, a desirable feature would be that the float assembly 14 has added weight on the downside, while not diminishing net buoyant force on the upside. One way of accomplishing this is the addition of a reservoir 48 to the top of the float assembly 14 (or integrating the reservoir within an upper alignment bumper 44). The reservoir 48 may be capable of capturing production fluid, such that when the fluid level in the well drops below the top of the reservoir 48, the fluid trapped within the reservoir 48 will serve to add to the weight of the float assembly 14 and exert a downward force. In contrast, when the well fluid rises relative to the bottom of the reservoir 48, the weight of the fluid contained within the reservoir 48 is lessened until it reaches zero when the fluid level reaches the top of the reservoir 48. In this way, the reservoir feature allows for the variation of both buoyant force and weight by varying the size of the reservoir 48.

Twisting of the float assembly 14 could put a torsional load on the lever arm 22 and/or cause any wires 24 running through the float assembly 14 to twist and potentially cause the float assembly 14 to bind. As such, the inner float tube 30 may include at least one anti-rotation guide 50 to help prevent the float assembly 14 from twisting during operation.

In order to maximize the diameter and buoyancy of the float assembly 14, a lower centralizer 52 may be positioned below the float assembly 14 and/or an upper centralizer 54 may be positioned above the float assembly 14 to center the float assembly 14 in the well and prevent the float assembly 14 from hitting the side of the well bore and possible binding up during operation. This is done instead of placing a protective covering over the float assembly 14 and further limiting the float's outer diameter. In addition to centering the float assembly 14 in the well bore, the upper centralizer 54 may also be designed to control the amount of oil pad that can flow into the pumping area below the upper centralizer 54. In this embodiment, the upper centralizer 54 may include a flat disc 56 formed from neoprene, or a comparable material. The flat disc 56 may have a vertical flange 58 running around its outer diameter, such that when the fluid level control level mechanism 10 is lowered into the well, the upper centralizer 54 has a smaller diameter than the well bore and the oil pad flows past the disc 56 thereby gathering above the disc 56. Once the disc 56 reaches the production zone's liner, however, with its smaller diameter, the disc 56 now acts like a centralizer centering the float 14 in the liner while also trapping the oil pad above the disc 56. Based on the viscosity and depth of the oil pad, at least one hole 60 may be sized and drilled in the disc which will allow the pad to slowly drip into the pumping area and allow the oil pad to be slowly pumped to the surface and removed from the well bore. If, over time, a new pad is created below the upper centralizer 54, well production can be temporarily shut down, even if only for a few minutes. During this time, fluid in the well will rise, thereby putting pressure on the lower surface of the disc 56, causing the outer edges of the disc 56 to bow upward allowing the pad to flow past the upper centralizer 54. When the well is restarted, the pressure on the disc 56 will be relieved and the disc 56 will fall back to its original position, thereby trapping the oil pad above the centralizer 54. In wells where a liner is not used (i.e., the well bore is a constant diameter over its entire length), a check valve may be inserted onto the upper centralizer 54. This check valve allows the pad to flow through the upper centralizer 54 during insertion into the well, but will not allow back flow. As such, the only flow back is through the holes 60 in the centralizer 54.

The main flow line 16 may include at least one alignment blade 62 protruding outwardly from the surface of the main flow line 16. These alignment blades 62 may serve many functions. For example, the alignment blade 62 may serve to center the float assembly 14 on the main flow line 16. The alignment blade 62 may also prevent rotation of the float assembly 15 when aligned with an anti-rotation guide 50 in the float assembly 14. Furthermore, the alignment blade 62 may minimize friction between the float assembly 14 and the main flow line 16, help guide electrical wires 24 through the space between the float assembly 14 and the main flow line 16, and/or clean the interface between the float assembly 14 and the alignment blade 62 as the float assembly 14 moves up and down.

If electrical wires 24 are present, for example if an electrical downhole pump with motor is utilized, the wires 24 may run from the pump in the space between the center of the float assembly 14 and the main flow line 16. By running the wires 24 through this area, they are kept away from the well bore and the outside of the float assembly 14 and prevent any possible interference with the float assembly 14 and the well bore.

The main flow line 16 may include an upper stop 64 and/or a lower stop 66 to limit the movement of the float assembly 14. For example, the upper stop 64 may be positioned along the length of the main flow line 16 above the float assembly 14 such that when the diverter valve 18 is fully closed, the float assembly 14 and upper stop 64 are in physical contact, thereby transferring any further buoyant force to the upper stop 64. Similarly, the lower stop 66 may be positioned along the length of the main flow line 16 below the float assembly 14 such that when the diverter valve 18 is fully opened, the float assembly 14 and lower stop 66 are in physical contact, thereby transferring any further downward force to the lower stop 66. As such, the stops 64, 66 may prevent excessive torque from being applied to the valve. By adjusting the location of the stops 64, 66 and/or the length of the lever arm 22, float assembly movement may be adjusted to the exact open and closed positions of the diverter valve 18 or some intermediate position if valve operation is to be limited. The stops 64, 66 may further act as wire guides.

Additionally, a self-cleaning filter may be added to the mechanism 10 if it is anticipated that the function of the diverter valve 18 may be degraded due to contaminants (such as sand, salt, paraffin, etc.). Furthermore, pressure regulators and/or fixed orifices may be added to the diverter line 20 to control pressure and flow rates as is necessary. Although optional, a secondary float assembly may be positioned below the primary float assembly 14. For example, the secondary float assembly could be connected to an on-off switch of a downhole electric motor to protect the pump and motor should the primary float assembly 14 fail.

In an alternative embodiment, the diverter valve is eliminated and replaced with a sliding sleeve inserted in line with the production string. The sleeve assembly contains two main parts: a housing and a sleeve. The housing may be a length of pipe with at least one hole in its side. Above and below the hole are two O-rings contained within grooves of the pipe. This housing is inserted directly into the production string. The sleeve may be a second piece of pipe that attaches to the float assembly 14 and slides over the O-rings on the housing. By compressing the O-rings between the housing and the sleeve, a dynamic seal is formed. As the float assembly 14 moves up and down, the sleeve slides up and down over the O-rings of the housing. The sleeve may have a vertical slot in its side, such that when the float assembly 14 exerts a buoyant force on the sleeve, the sleeve slides up and the slot sits above the upper O-ring. In this position, the production fluid cannot flow through the hole in the housing because it is blocked by the walls of the sleeve and the upper and lower O-rings. The sleeve's contact with the O-rings seals off any possible flow. When the fluid level in the well falls to the float assembly level, the buoyant force is reduced. As the float assembly 14 sinks, it forces the sleeve downward, such that when the slot in the sleeve slides down below the upper O-ring in the housing, production fluid will begin to flow through the hole in the housing, out through the slot, and into the well bore. The sleeve will move up and down, as required, to maintain a constant fluid level within the well bore. In this embodiment, the float assembly 14 length would be determined by the force needed to overcome the O-ring frictional force.

In another alternative embodiment, the diverter valve is replaced with a plunger design. In this embodiment, the float assembly 14 actuates a plunger which slides up and down inside a plunger housing. When the float assembly 14 is submerged, the plunger rises sealing an orifice in the top of the plunger housing. An O-ring, or surface-to-surface contact forms the seal between the plunger and the housing. This seal prevents leakage of production fluid during normal production. The vertical force required to create a seal determines the length of the float assembly 14. The plunger housing has slots machined into its walls. The slots are located below the sealing interface between the plunger and the plunger housing. As the fluid level drops to the level of the float 14, the float 14 begins to sink and the plunger slides down the inside of the housing and below the slots. Fluid is then allowed to flow through the bypass line, through the orifice, and out the slots into the well bore. In this embodiment, the length of the float assembly 14 is determined by the forces required to form a seal between the plunger and the plunger housing.

The above description is given by way of example, and not limitation. Given the above disclosure, one skilled in the art could devise variations that are within the scope and spirit of the invention disclosed herein, including various ways of optimizing the size and pressurization of the float assembly depending on, for example, the depth of the well, the approximate amount of fluid the well can produce, the amount of fluid to be diverted, the viscosity of the production fluid, sizing of the well bore and production string, and the quality of the production fluid. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A fluid level control mechanism comprising:

a float assembly, a flow line assembly, an upper centralizer, and a lower centralizer;

said float assembly comprising a cylindrical outer float tube and a cylindrical inner float tube, wherein an upper portion of the outer float tube is connected to an upper portion of the inner float tube by an upper end plate disposed between the outer and inner float tubes and a lower portion of the outer float tube is connected to a lower portion of the inner float tube by a lower end plate disposed between the outer and inner float tubes, thereby forming a sealed cavity between the outer float tube and the inner float tube, the float assembly having an upper bumper attached to an upper portion of the float assembly, wherein the upper bumper tapers to a diameter narrower than the diameter of the float assembly and further comprises a liquid reservoir portion capable of containing a liquid;

said flow line assembly positioned below the float assembly and comprising a main flow line capable of passing a fluid therethrough, a diverter flow line in fluid communication with the main flow line, and a diverter valve disposed within the diverter flow line, wherein the diverter valve is connected to the lower end plate of the float assembly via a lever arm;

wherein the float assembly is disposed along a length of the main flow line and capable of sliding movement along the length of the main flow line, wherein a downward movement of the float assembly opens the diverter valve and an upward movement of the float assembly closes the diverter valve; and wherein the lower centralizer is positioned along the main flow line below the flow line assembly and the upper centralizer is positioned along the main flow line above the float assembly, wherein the upper and lower centralizers each have a diameter larger than the float assembly.

2. The fluid level control mechanism of claim 1 further comprising at least one rib plate, wherein a middle portion of the outer float tube is connected to a middle portion of the inner float tube by the rib plate, and wherein the rib plate has at least one hole for allowing the passage of air.

3. The fluid level control mechanism of claim 1 further comprising a lower bumper attached to a lower portion of the float assembly, wherein the lower bumper tapers to a diameter narrower than the diameter of the float assembly.

4. The fluid level control mechanism of claim 1 wherein the float assembly is pressurized.

5. The fluid level control mechanism of claim 4, wherein the float assembly further comprises a pressure valve disposed between the inner float tube and the outer float tube.

6. The fluid level control mechanism of claim 1, wherein the upper centralizer comprises a disc having a diameter greater than the diameter of the float assembly.

7. The fluid level control mechanism of claim 6, wherein the upper centralizer disc is formed from polychloroprene.

8. The fluid level control mechanism of claim 7, wherein the upper centralizer disc has at least one hole capable of passing a fluid therethrough.

9. The fluid level control mechanism of claim 1 further comprising an upper float stop positioned on the main flow line above the float assembly, such that when the diverter valve is fully closed an upper portion of the float assembly is in contact with the upper float stop, and a lower float stop positioned on the main flow line below the float assembly, such that when the diverter valve is fully opened a lower portion of the float assembly is in contact with lower float stop.

10. The fluid level control mechanism of claim 1 further comprising at least one alignment blade protruding outward from the main flow line and at least one anti-rotation guide disposed within the inner float tube.

11. The fluid level control mechanism of claim 1, wherein the outer float tube, inner float tube, upper end plate, and lower end plate are formed from aluminum.

12. The fluid level control mechanism of claim 1, wherein the main flow line is stainless steel tubing.

13. The fluid level control mechanism of claim 1 further comprising a valve extension arm positioned between the diverter valve and the lever arm.

14. A pumping apparatus comprising:

an electrically driven downhole pump; and a fluid level control mechanism, wherein the fluid level control mechanism is disposed above the downhole pump and comprises a float assembly and a flow line assembly;

said float assembly comprising a cylindrical outer float tube and a cylindrical inner float tube, wherein an upper portion of the outer float tube is connected to an upper portion of the inner float tube by an upper end plate disposed between the outer and inner float tubes and a lower portion of the outer float tube is connected to a lower portion of the inner float tube by a lower end plate disposed between the outer and inner float tubes, thereby forming a sealed cavity between the outer float tube and the inner float tube, the float assembly having an upper bumper attached to an upper portion of the float assembly, wherein the upper bumper tapers to a diameter narrower than the diameter of the float assembly and further comprises a liquid reservoir portion capable of containing a liquid;

said flow line assembly positioned below the float assembly and comprising a main flow line capable of passing a fluid therethrough, a diverter flow line in fluid communication with the main flow line, and a diverter valve disposed within the diverter flow line, wherein the diverter valve is connected to the lower end plate of the float assembly via a lever arm;

wherein the float assembly is disposed along a length of the main flow line and capable of sliding movement along the length of the main flow line, wherein a downward movement of the float assembly opens the diverter valve and an upward movement of the float assembly closes the diverter valve.

* * * * *